United States Patent [19]

Gasser

[11] Patent Number: 4,771,481

[45] Date of Patent: Sep. 20, 1988

[54] HOLDER FOR PRE-KNOTTED NECKTIES

[76] Inventor: Arthur Gasser, Bungertweg 23, CH-8600 Dubendorf, Switzerland

[21] Appl. No.: 36,600

[22] Filed: Apr. 10, 1987

[51] Int. Cl.[4] ..... A41D 25/08

[52] U.S. Cl. ..... 2/150; 2/152 R; 2/153

[58] Field of Search ..... 2/150, 152 R, 153

[56] References Cited

U.S. PATENT DOCUMENTS

| | | | |
|---|---|---|---|
| 3,898,698 | 8/1975 | Byrd et al. | 2/150 |
| 3,942,192 | 3/1976 | Harris | 2/152 R |
| 4,513,453 | 4/1985 | Chen et al. | 2/150 |
| 4,615,048 | 10/1986 | Gasser | 2/153 |
| 4,656,672 | 4/1987 | Lande | 2/150 |

FOREIGN PATENT DOCUMENTS

| | | |
|---|---|---|
| 1178162 | 5/1959 | France . |
| 0490818 | 7/1970 | Switzerland . |

*Primary Examiner*—Louis K. Rimrodt

*Attorney, Agent, or Firm*—Ostrolenk, Faber, Gerb & Soffen

[57] ABSTRACT

Pre-tied neckties include a slide fastener and two slide tapes which are joined by the slide fastener. The tapes of the slide fastener extend through a pair of tubes which meet at a fastening rivet. A spacer is placed there for keeping the guide tubes and the tapes properly spaced. The spacer is located in the vicinity of the knot where the front and rear parts of the tie are connected. A strap may be attached to the slideable element to the slide and the strap is movable to different orientations with respect to the slideable element. The rear part of the tie may have an opening or slit which receives the slide fastener and the bottom portion of the guide tubes.

14 Claims, 8 Drawing Sheets

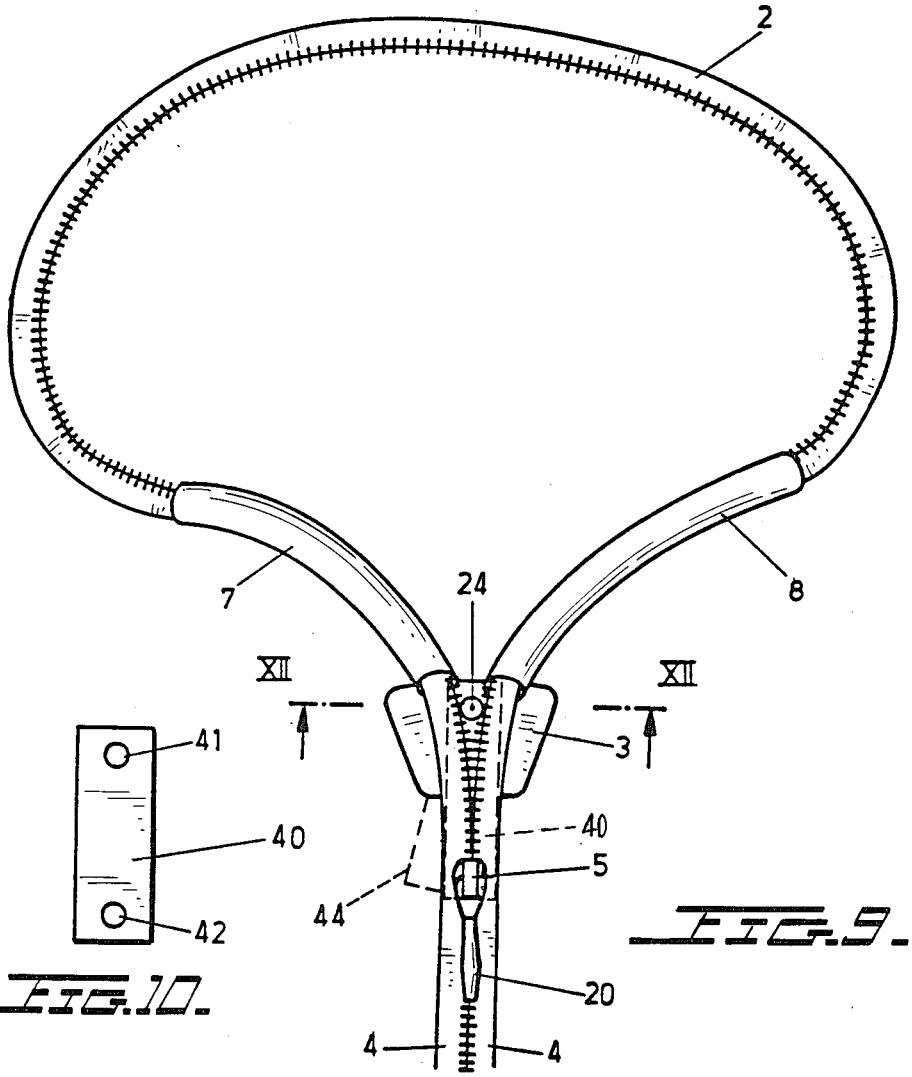
FIG. 9.
FIG. 10.
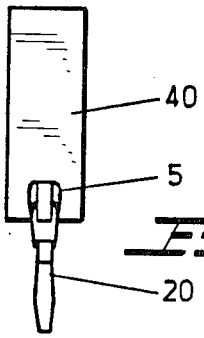
FIG. 11.
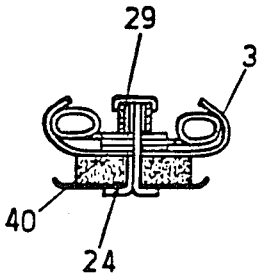
FIG. 12.

HOLDER FOR PRE-KNOTTED NECKTIES

BACKGROUND OF THE INVENTION

The present invention relates to pre-knotted neckties and to the slide fastener for those neckties. The present invention is an improvement upon the neckties and holder disclosed and claimed in U.S. Pat. No. 4,615,048 issued to the present invention (hereinafter the "previous invention"). That patent is entirely incorporated by reference herein. The specification of the patent is prior art for the present invention. The "Background of the Invention" section of the patent will now be reproduced substantially in its entirety.

BACKGROUND OF THE PREVIOUS INVENTION

The previous invention relates to a holder for pre-knotted neckties, and particularly a holder which has a slide fastener or zipper of the known type. The holder includes an elongate tape with a loop in it which can be placed around the neck and can be adjusted by moving the slide of a slide fastener.

In known pre-knotted neckties of this type, the slide is rigidly connected with the front of the hollow holder. That holder consists of still material such as brass plate, etc. The slide fastener, which has metal, nylon or plastic teeth, consists of two tapes, which are not attached to the material of the neckties, and a slide movable for joining the sets of teeth on the two tapes. These tapes pass through the two small tubes of plastic, or the like, which are located in the necktie-knot holder and which extend in V shape to below the wearer's collar. At their upper ends, they are so connected to each other as to form a loop which can be placed around a wearer's neck.

In pre-knotted neckties of this type, the permanent attachment of the slide to the holder by soldering or riveting has a number of disadvantages.

For a wearer of a necktie who is in the habit of pulling somewhat on the necktie in order to bring the knot exactly into the center of the collar, as is customary in the case of a self-knotted necktie, this completely blocks the slide operation, as the slide cannot move away under pressure, since it is rigidly connected to the holder. If the wearer of the necktie wishes to actuate the release mechanism by pulling on the pull tab of the slide-fastener slide, in order to unlock the necktie from the collar by lengthening the loop, the slide cannot be opened. In order to eliminate this lock, it would have been sufficient to push the knot in the slide fastener a few millimeters further against the neck and then again pull on the tab. Unfortunately, many of these necktie wearers lose patience and cut the slide-fastener tape, so that the necktie is thereafter unusable. Due to its firm attachment to the holder, the slide also comes to lie too near the knot, so that, in particular, wearers who have clumsy or large fingers have difficulty, particularly in the case of wider neckties with large knots, in finding the pull tab for the slide and in actuating the release mechanism.

The previous invention eliminates these disadvantages. It does away with the rigid connection of the slide of the slide fastener or zipper to the holder. Now, blocking of the release mechanism is prevented, since the slide can now yield to any pressure caused by pulling on the necktie etc. In this way, it also becomes possible for normal massproduced slides of high quality to be used, and these are considerably cheaper to manufacture. Furthermore, the costly expense for soldering or riveting is avoided. Since there is now also less waste, a substantial saving can be obtained in the cost of manufacture, as well as in the warranty expenses.

In accordance with the previous invention, the slide lies outside the body of the knot. It is not firmly connected to the knot. Furthermore, one or both of the plastic tubes extends beyond the lower part of the holder and serves as an end stop for the slide-fastener slide in the upward direction toward the inside of the knot. The corresponding slide fastener also preferably consists only of a single left-hand or right-hand tape part of a nylon or plastic endless spiral slide-fastener or zipper. This part is passed from below up one side through the slide, through the tube present in the body of the knot, and then forms on top a loop, which is seamless. Then the part of the same tape on the other side is passed through the other tube present in the body of the knot, downward through the other side of the slide. The holder is supported by internal support against deformation and indentation.

By elimination of soldering or riveting, instead of using electroplated or galvanized slides, it is possible to also use enameled or spray-lacquered slides and zippers, as well as slide-fastener tapes of different colors, which are adapted to the colors of the material of the neckties. A further improvement and a decrease in the cost of manufacture is obtained in using only one-half of an endless slide-fastener tape to form a loop and then to place it under the collar. This can be done instead of using a conventional metal or nylon two-part zipper slide fastener. In this way, the sewing together of the two individual slide-fastener tape halves to form a loop is avoided. Furthermore, the two starting parts as well as the end part of the slide fastener are no longer required. As a result, the wearer's collar will no longer be injured by the starting parts of metal. Upon manufacture, the possible elimination of damaged spiral slide-fastener tapes is less expensive than the removal of damaged conventional slide fasteners.

In previous slide-fastener neckties, disturbances in operation frequently occurred because the holder was squeezed during manufacture or by the wearer. This caused difficulties in connection with the passage of the tape or else caused damage to the tape. Furthermore, the shape and the appearance of the neckties suffered from the deformation. The previous invention also eliminates this defect by the use of a so-called hollow, intermediate or support tube, through which the same spreader clamp, or the like, is passed that serves for connecting the plastic tubes and the necktie to the holder. Furthermore, the intermediate plastic tube assures that the thread connection between the necktie material coverings of the two tubes extending out of the top of the knot are not cut or worn through by the spreader-clamp connection, or the like. In this way, the coverings can no longer come away from the tubes or out of the knot.

In order to prevent the slide from passing too deeply into the knot of the necktie and in order to obtain a lower position of the slide for the easier grasping of the pull tab, two additional downwardly extending plastic tubes are arranged in such a manner that they form an X together with the two previous upper, upwardly extending plastic tubes. Alternatively, the two previous plastic tubes are extended, in parallel to each other or diagonally downward, so that they protrude definitely below the holder and thus form an upper stop against the inside of the body of the knot to block the slide-fastener slide. The slide now comes to lie completely below the outside of the holder. Furthermore, better guidance of the slide-fastener tape or tapes is obtained.

For a person who wears a pre-knotted necktie, it is important that no difference can be noted from a self-tied necktie in the nature or shape of the knot. In previous neckties of this type, the shape of the knot frequently was undesirable and gave evidence that the necktie was not self-knotted. This problem is also eliminated in the previous invention in that the shaped body made of sponge, plastic or the like, which is placed on the shaping member now has a V or trapezoidal shape.

SUMMARY OF THE PREVIOUS INVENTION

A holder for pre-tied neckties includes a slide fastener and corresponding slide-fastener tapes which are joined by the slide fastener. A supporting and shaping member for the necktie knot is connected by a clamp to two plastic tubes which extend in approximately a V shape toward that member. The slide of the slide fastener is arranged to lie outside the body of the knot and thus is not connected it, and is freely movable with respect to the supporting and shaping member. This is accomplished by extending the tubes sufficiently downwards to serve as a stop so that the slide can be moved only to a position below the shaping member.

SUMMARY OF THE PRESENT INVENTION

The present invention provides a modification of the holder construction shown in U.S. Pat. No. 4,615,048. In particular, the pre-tied necktie of the present invention includes a support which is attached to the neck of the wearer. From the support extends a pair of tapes which are secured together by a slide fastener slide which is movable along the tapes. The necktie for which the present invention is useful has a front part which is outward and a rear part which is behind the front part and is inward against the wearer. There are connecting means for connecting the front and rear parts together. For a tie with a knot, the knot would be typically provided generally at the location where the front and rear parts are connected together. There are guide and enveloping means in the form of plastic tubes through which the tapes pass. Those guide means are generally at the place where the front and rear parts of the necktie are connected together. A spacer disposed at the general area where the front and rear parts are connected together spaces the guide and enveloping means and the tapes to enable the slide fastener to operate. There is a stop for movement of the slide in the vicinity of the spacer or where the front and rear parts of the tie are connected together.

The rear part of the tie is typically substantially shorter and narrower than the front part in normal necktie design. The rear part of the tie may define a protective cap or covering in which the slide is received and is movable. The guide and enveloping means for the tapes, or at least the bottom part thereof, is also received in the rear part of the tie. If those elements are not received in the rear part, the rear part covers and obscures them from view. Alternately, the slide may be between the front and rear parts of the tie.

The slide fastener includes the slide element which moves along the slide tapes. The slide fastener may additionally include a grippable strap attached to the slide fastener and the orientation of that strap is adjustable with respect to the slide element.

Various embodiments of the invention are explained below with reference to the drawings.

BRIEF DESCRIPTION OF THE DRAWINGS

FIGS. 9–19 illustrate the present invention.

FIG. 1 is a front view of a prior art necktie holder with neck loop partially pulled out and a necktie, indicated in dash-dot line, looped on the holder;

FIG. 2 is a rear view of the embodiment of FIG. 1;

FIG. 3 is a view of the blank for the supporting and shaping member, with tab bending edges indicated in dot-dash line;

FIG. 4 shows a portion of the upper part of a necktie holder with necktie protection parts;

FIG. 5 shows the protective tubes for the slide-fastener tapes in the region of the supporting and shaping member;

FIG. 6 is a variant of the embodiment shown in FIG. 5;

FIG. 7 shows a portion of a plastic tube;

FIG. 8 is a further variant of the embodiment of FIG. 5;

FIG. 9 is a front view of a necktie holder according to a first embodiment of the present invention;

FIG. 10 illustrates a first embodiment of strap for use with the necktie holder:

FIG. 11 illustrates a second embodiment of a strap for use with the necktie holder;

FIG. 12 is a cross-sectional view of the necktie holder shown in FIG. 9 along the line XII—XII of FIG. 9;

FIG. 13 is a front view of a portion of a second embodiment of a necktie holder according to the present invention;

FIG. 14 illustrates a modification of the necktie holder of FIG. 13;

FIG. 15 is a partial front view of a third embodiment of necktie holder according to the present invention;

FIG. 16 is a front view of a fourth embodiment of necktie holder according to the invention;

FIG. 17 is a front view of a fifth embodiment of a necktie holder according to the invention;

FIG. 18 is a front view of a sixth embodiment of a necktie holder according to the invention; and FIG. 19 is a front view of a seventh embodiment of a necktie holder according to the invention.

DESCRIPTION OF PRIOR ART EMBODIMENTS

Figure 1:
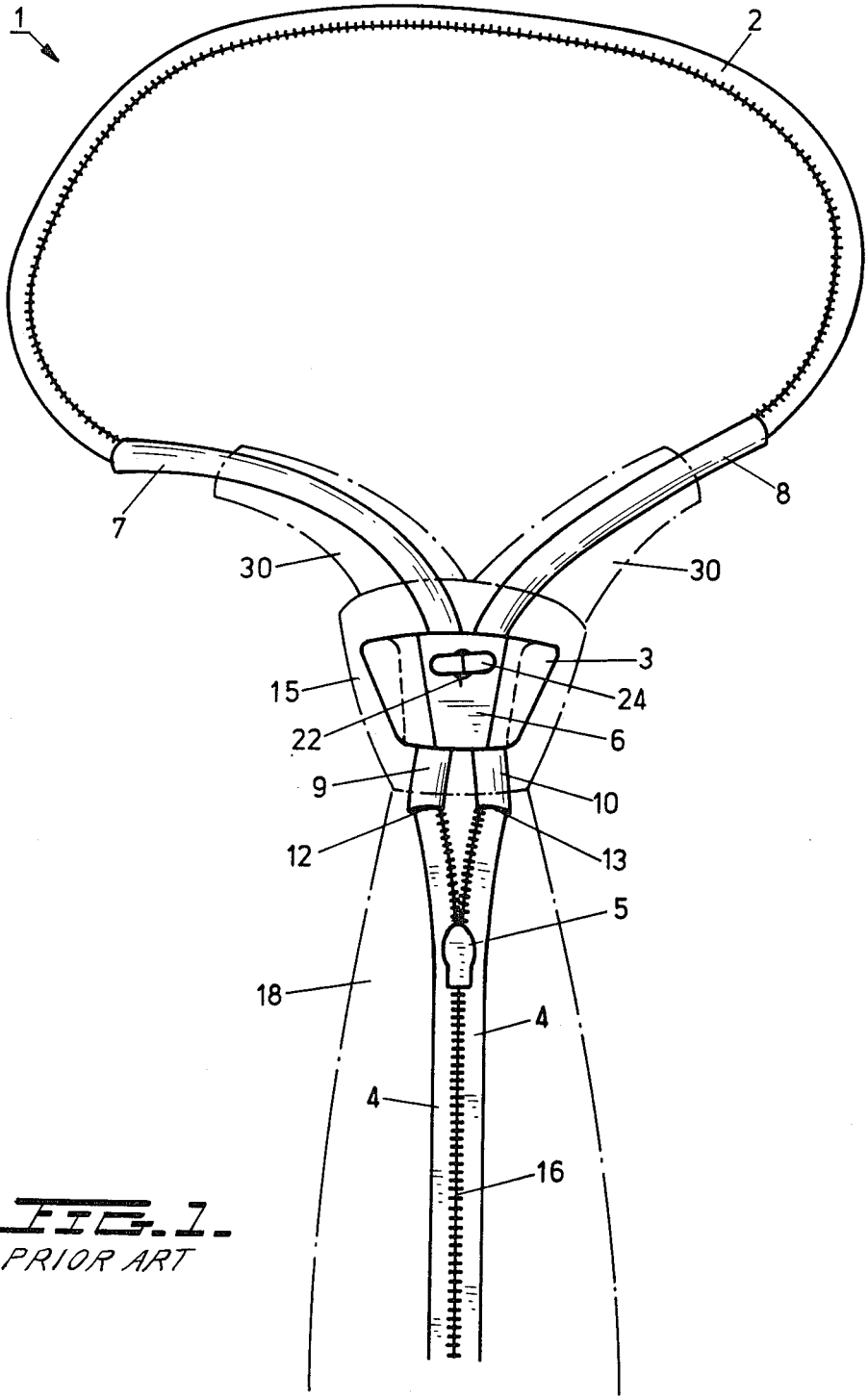
FIG. 1 PRIOR ART
FIGS. 1–8 appear in U.S. Pat. No. 4,615,048 and are repeated here as background for understanding the present invention. They depict prior art, therefore.
Figure 2:
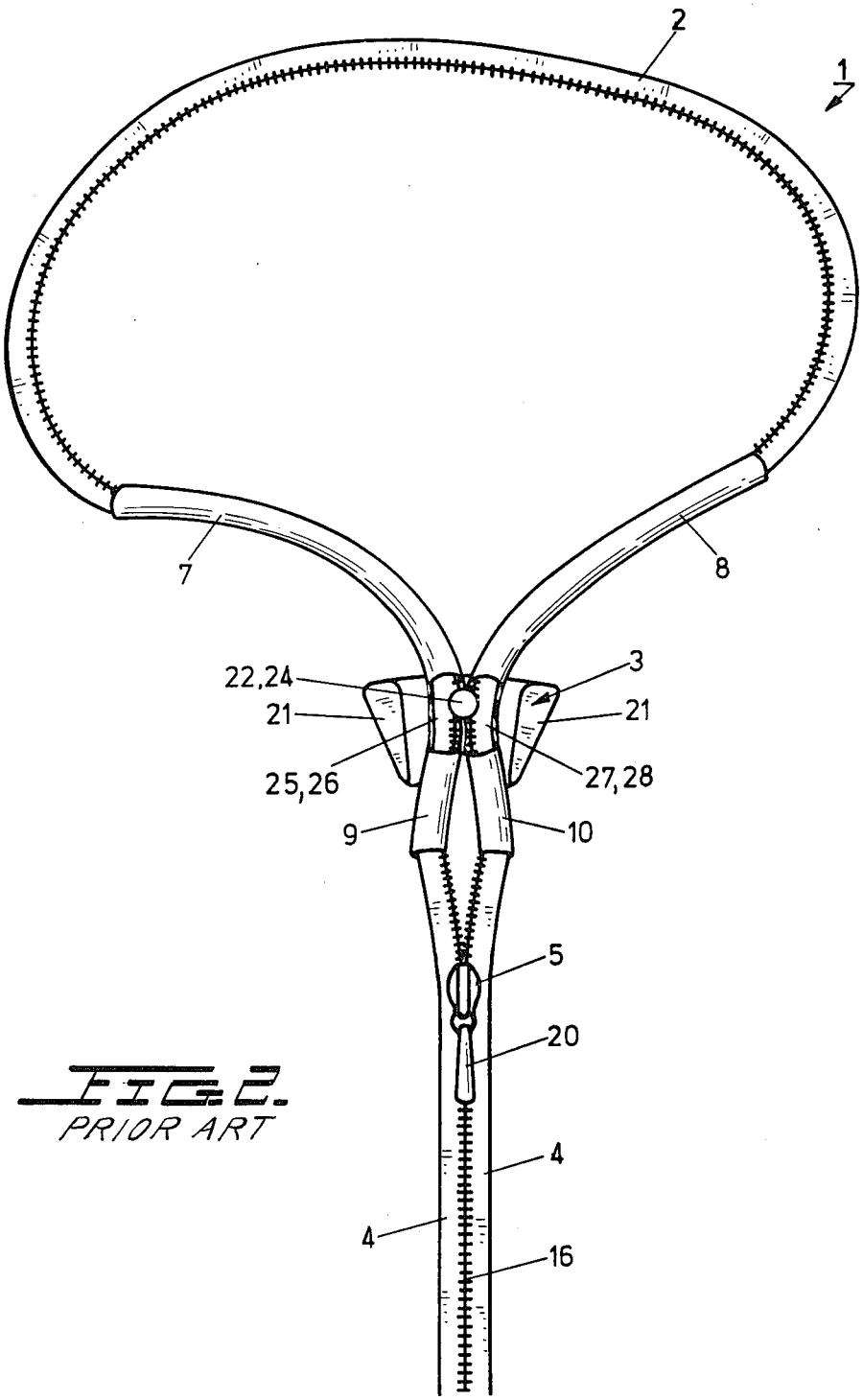
FIG. 2. PRIOR ART

FIGS. 1 and 2 show a necktie holder 1 with a neck loop 2 and a supporting and shaping member 3. The neck loop 2 is formed of one half of a continuous zipper chain or slide-fastener tape 4. After the formation of the neck loop 2, the two ends of that tape are joined together in a slide-fastener slide 5. The loop 2 is closed or opened by moving the slide so as to narrow or widen the neck loop 2.

On the front side of the supporting and shaping member 3, there is a pad 6 which normally is comprised of sponge rubber and is fastened, for instance, by adhesive, to the shaping member. Extending up from the supporting and shaping member 3, there are two plastic tubes 7 and 8 which receive the parts of the loop in the region of the shaping member 3. The tubes 7 and 8 protect the loop from jamming in the region of the shaping member. Another two plastic tubes 9 and 10 protrude downward from the shaping member 3. The two tapes of the neck loop 2 protrude from the respective ends 12 and 13 of the tubes 9 and 10. The two tapes are joined together by the slide fastener slide 5 to form a slide fastener 16.

Around the shaping member 3 there is shown, in dot-dash line, the actual knot 15 of the necktie and the bottom part 18 of the necktie. At the top, the plastic tubes 7 and 8 are wrapped with the material of the necktie.

Figure 3:
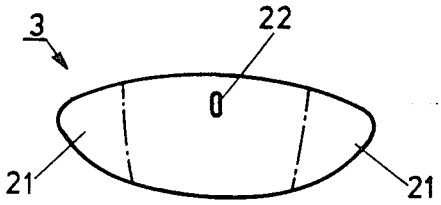
FIG. 3. PRIOR ART

FIG. 2 shows the pull tab 20 for the slide fastener slide 5. It also shows two shaping-member tabs 21 which, as shown in FIG. 3, form parts of the supporting and shaping member 3. Along the bending lines indicated in dot-dash lines in FIG. 3, these parts are bent inward as seen in FIG. 2 in order to form a hollow space for the passage of the slide-fastener tape 4. Furthermore, a place of attachment for the plastic tubes 7–10 is established. An opening 22 in the supporting and shaping member 3 cooperates with a holding clamp 24 in FIG. 5 to connect the tubes to the member 3. That clamp is passed through corresponding openings in the fastening tabs 25–28, which are formed after the cutting away of a part of the corresponding tubes 7–10. The holding clamp is pushed through the opening 22. After the necktie to be knotted has been received, the two free ends of the holding clamp 24 are passed through the front of the necktie and are bent over. The clamp which could be in the form of a cotter pin connects the necktie front, pad, shaping member and the plastic tubes together.

A plastic or metal tube of a diameter of about 5 mm and a length of about 5 to 10 mm is provided for the holding clamp. This tube protects the plate like material of the shaping member 3 from deformations caused by pressing or bulging.

Figure 4:
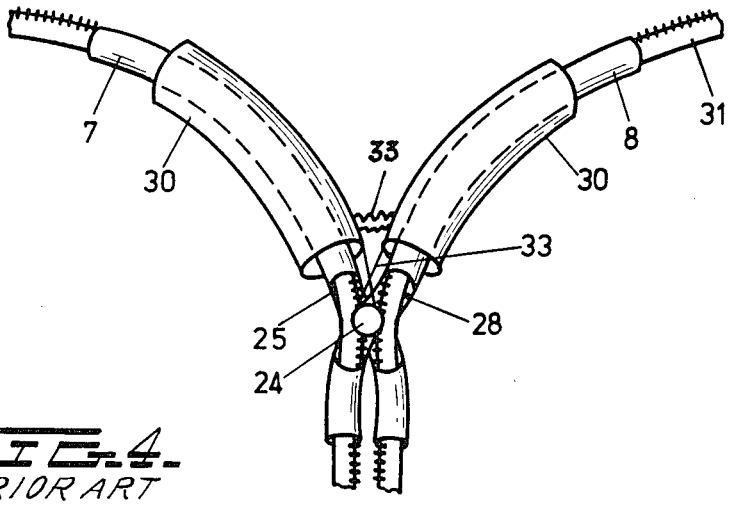
FIG. 4. PRIOR ART

As can be noted in FIGS. 1 and 4, the plastic tubes 7 and 8 are provided with a covering 30 of the same material as that of the necktie. These tubes receive the endless spiral zipper or slide-fastener 31. The two tubes 7 and 8 are fastened to the shaping member 3 as explained above by means of their fastening 25 and 28, which are provided with corresponding passage openings, and by the holding clamp 24. The said covering for each of the plastic tubes 7 and 8 are here further connected together by means of a connecting thread 33.

Figure 5:
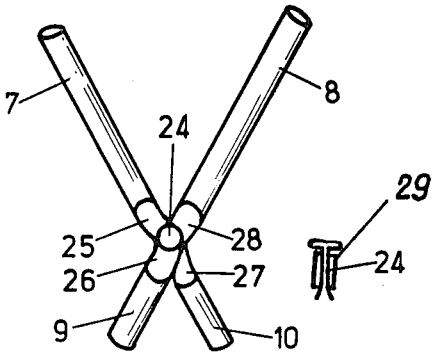
FIG. 5. PRIOR ART

FIGS. 5 to 8 show different embodiments of this tube construction. FIG. 5 shows a construction which can be noted from FIGS. 1 and 2, comprising four plastic tubes 7–10, which are separated from each other and which are connected to the shaping member 3 by means of their specific fastening tabs 25 and 28 and the holding clamp 24.

Figure 6:
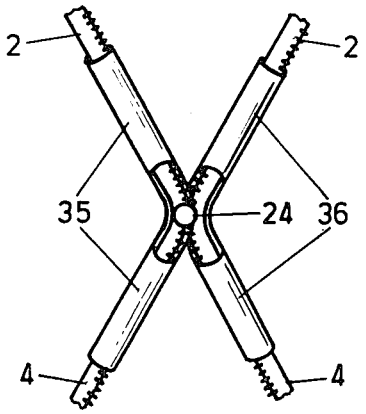
FIG. 6. PRIOR ART
Figure 8:
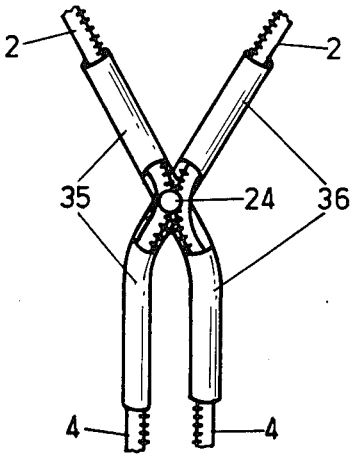
FIG. 8. PRIOR ART
Figure 7:
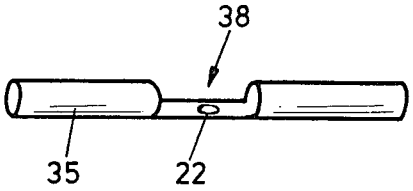
FIG. 7. PRIOR ART

In the embodiments in accordance with FIGS. 6 to 8, instead of four plastic tubes, there are only two plastic tubes 35 and 36, which are provided with fastening tabs or cutouts 38 in the regions of their attachments to the shaping member 3, as seen in FIG. 7. There is one opening 22 in each tube so that either in the manner shown in FIG. 6, with each tube lying alongside another, for receiving its slide-fastener tape or else, as shown in FIG. 8, the corresponding slide-fastener tape is continued upward in one tube 35 and, behind the place of attachment, in the other tube 36.

DESCRIPTION OF THE PREFERRED EMBODIMENTS

A first embodiment of the present invention is shown in FIGS. 9 to 12. FIG. 9 generally corresponds to the prior art showing of FIG. 2, the reference numbers of which have been employed for the same parts. In this embodiment, however, the slide-fastener slide 5 is no longer freely movable with respect to the supporting and shaping member 3 and is also not rigidly connected to it. The slide fastener slide is instead variable in position with respect to the member 3. For this purpose, a so-called strap 40, possibly in the form of a small chain, or the like, is provided, as in one of the embodiments shown in FIGS. 10 or 11. The strap 40 of FIG. 10 has two holes 41 and 42 at its ends. The hole 41 serves to swingably attach the strap 40, for instance, by the holding clamp 24 or by another rivet, to the supporting and shaping member 3, as shown by FIG. 12 which is at section XII—XII in FIG. 9. The holes 41 and 42 can also serve for the flow of solder. It has already been pointed out in preceding examples that a plastic spacer tube 29 can be arranged between the plastic tubes 7, 8, 9 and 10 or their regions of attachment and the head of the holding clamp 24.

The hole 42 receives the slide-fastener slide 5 which in this way is also swingably fastened to the strap 40. The slide-fastener slide 5 can freely swing within the region between the two shaping member tabs 21 and the base of the shaping member 3, i.e. also in the vertical region, even though the slide 5 is operatively connected to the supporting and shaping member 3.

However, instead of connecting the strap 40 resiliently to the supporting and shaping member 3 by means of the holding clamp 24, it is also possible to attach it by bonding, soldering, or the like, and to only fasten the slide-fastener slide 5 swingably on the strap 40 via the hole 42. Another possibility is to deform the strap 40 with spring action in such a manner that the slide-fastener slide 5 can also be attached rigidly to the strap. Nevertheless, a change in orientation of the slide 5 with respect to the supporting and shaping member 3 is possible.

In FIG. 9 a swing-out region 44 is shown in dashed line. In this way, the slide 5 is located outside the supporting and shaping member 3. It nevertheless remains easily movable, i.e. horizontally and vertically swingable, which assures unimpeded release upon movement of the slide-fastener slide.

Figure 13:
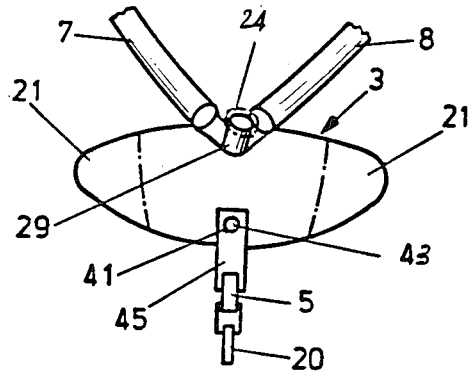
Figure 14:
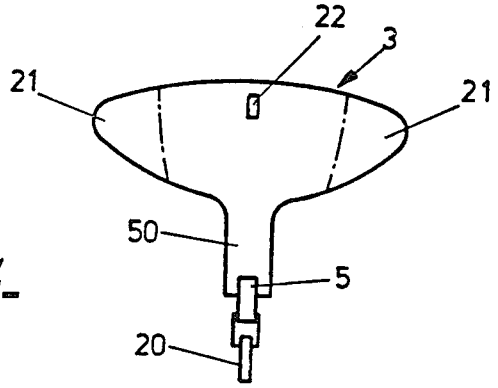

Further details of the supporting and shaping member 3 and of the arrangement of a normal strap 40 or of a short strap 45 is shown in FIGS. 13 and 14. In FIG. 13 a short strap 45 is swingably connected in the hole 41 to the member 3, for instance by means of a hollow rivet 43. The slide 5 is, for instance, bonded onto the other end of the short strap 45. The short strap 45 can also be attached to the member 3 by means of a hollow rivet.

In the embodiment shown in FIG. 14, the supporting and shaping member 3 is provided with a strap-like extension 50 to which the slide fastener slide 5 is soldered, riveted or bonded, as indicated. By a suitable selection of the material for the member 3 and of the development of the extension 50, the latter is loosely resilient and twistable whereby the slide fastener slide 5 is attached with variable orientation to the supporting and shaping member 3 and is not entirely firmly secured to it. This also assures unimpeded release of the slide fastener since the slide 5 is located outside the shaping member 3. Further, because of the flexibility of the strap-shaped extension 50, the unlocking of the slide 5 can be easily effected.

Figure 15:
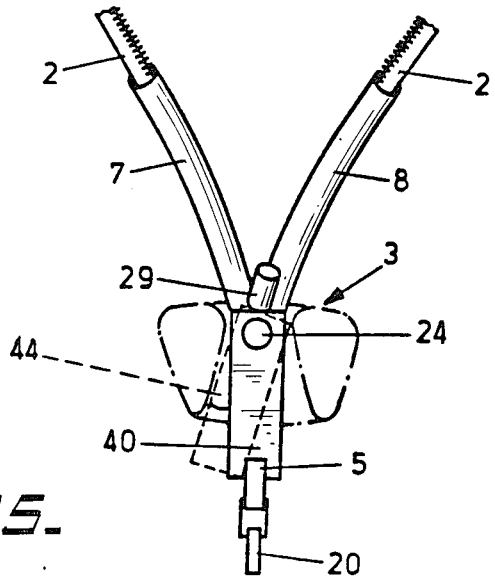

Another possible manner of attachment is shown in FIG. 15. This embodiment can be used with or without supporting and shaping members 3, shown in dot-dash line. In accordance with present-day fashion trends, leather and leather-like neckties with slide fastener are in demand. As a result of the stability of leather-like materials, it is possible to dispense with the supporting and shaping member 3. Then one may also dispense with the use of a cushion, or the like, of sponge, plastic, etc. arranged between the tie front and the shaping member 3. If a strap 40 or 45 is used, wherever the slide 5 is fastened to a strap 40, 45, it is possible to dispense with the lower short pair of tubes 9, 10 (FIG. 1) since the stop function for the slide 5 is unnecessary here. The range of swing 44, representing the loose attachment, is shown in dot-dash line. The tube 29 has been shown outside the clamp 24 for clarity.

Another problem with such pre-formed neckties is the absence of the rear or second part of the tie. Many possible wearers of ties of this type choose not to wear neckties because of the absence of this end part. A solution to this problem appears in FIGS. 16 to 19.

Figure 16:
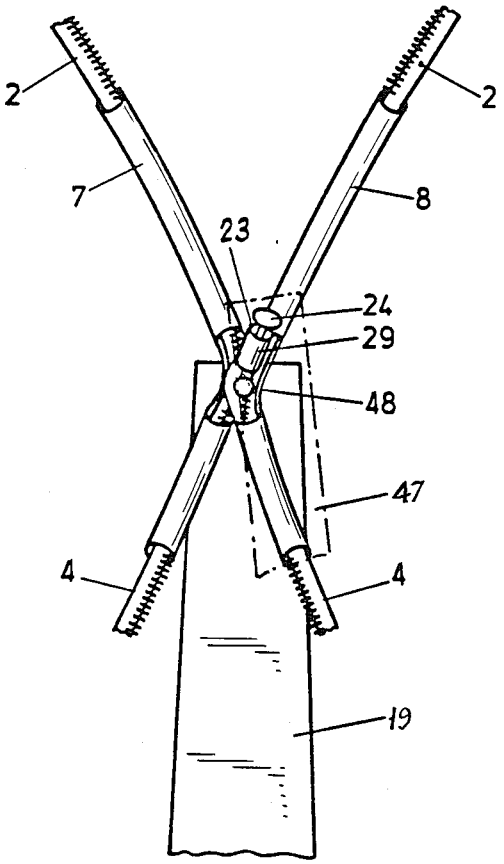
Figure 17:
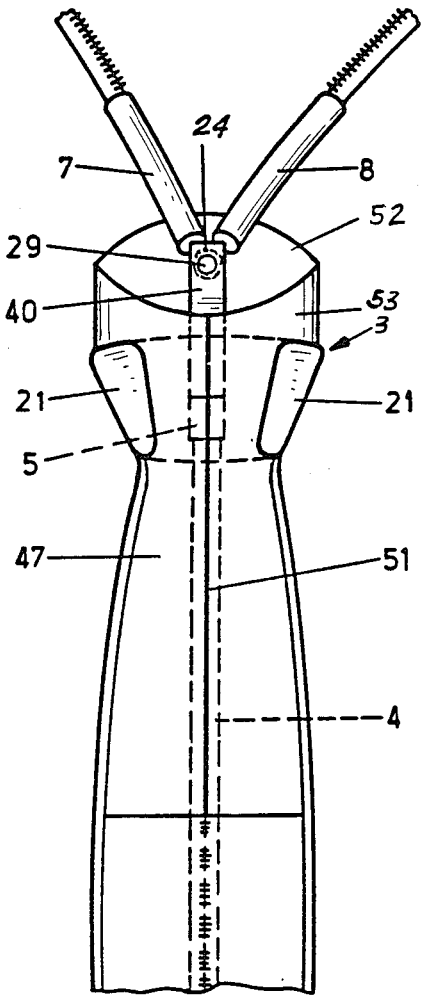
Figure 18:
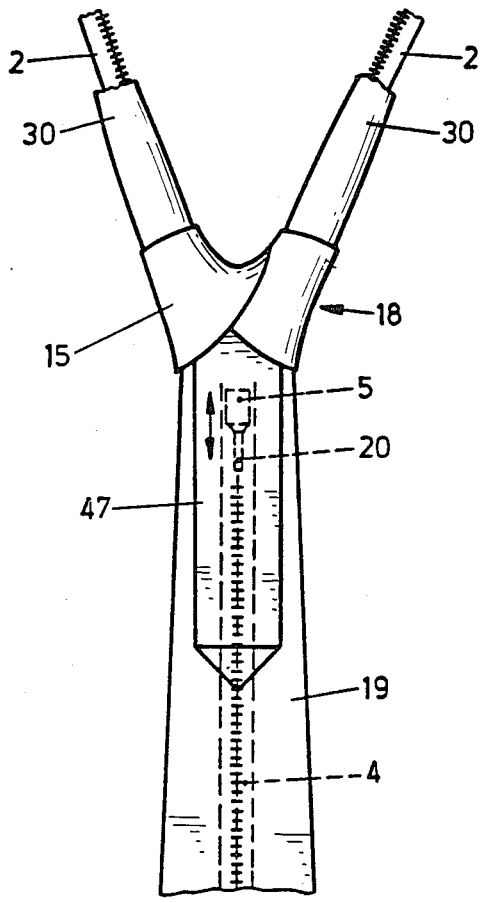
Figure 19:
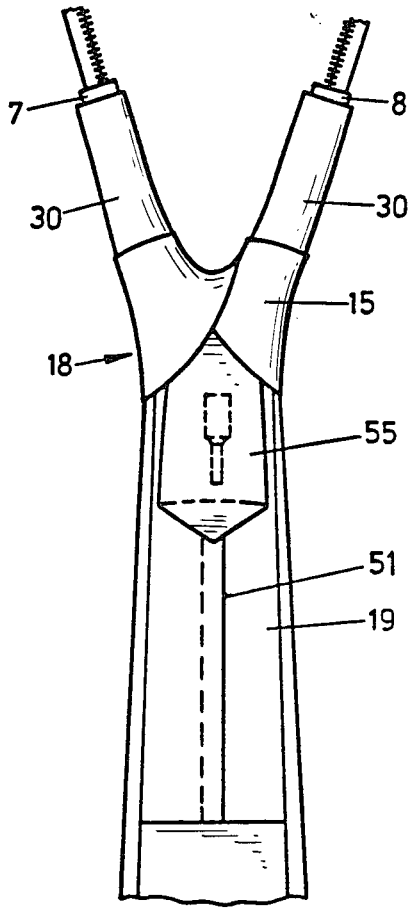

FIG. 16 shows a necktie of leather-like material, rather than textile material, which is therefore without a supporting and shaping member 3. A tie rear member 47 can be provided here. As shown, the rear member 47 is also attached by the holding clamp 24 between the latter and the spacer 29, indicated, for instance, as a tube 29 of any cross-sectional shape. This serves as a support, as indicated by 23, to the slide fastener tape 4 as well as the spacer tube 29 and plastic tubes 7, 8, in accordance with FIGS. 5 to 8, as well as the front part 19 of the tie. In this case, the rear part 47 of the tie can be shorter, depending on the model, as shown in FIG. 18, than the front part 19 of the tie, or can be developed, as shown in FIG. 17, with the same length. FIG. 17 shows how the slide fastener can be placed substantially invisibly within the front part 19 of the tie so as not to be unpleasantly visible. Such a tie thus provides optimum comfort in handling and furthermore gives the user a feeling as though he is really wearing an ordinary necktie that he has tied himself.

Since no tie material is placed around the neck, considerable material is saved. The wearer of the tie does not feel choked and he is comfortable even in hot weather.

Downward hanging, externally visible pull tabs 20 of the slide-fastener 5 are disagreeable, particularly in the case of narrow ties, since they may be visible from the side. Providing a short rear tie part 47 eliminates this disadvantage if the pull tab 20 is embedded, held fast or clamped flat between the front part 19 and the rear part 47 of the tie 18. In this way, the pull tab 20 is no longer noticeable to others.

Another possibility, which would be used mostly in the case of leather-like materials, is to develop the rear part of the tie as a downwardly open protective cap 55 which is long enough that at least the pull tab 20 of the slide fastener slide 5 is covered.

As a further possibility, the short rear part 47 of the tie can be developed so that the slide fastener is introduced directly into it from inside the supporting and shaping member 3, together with the short tube possibly applied or the strap 40, 45 possibly applied. The slide fastener end part having the slide 5 and the pull tab 20 as well as the strap 40, 45 or the short tubes 9, 10 can be concealed well within the member 3. A slit 51 receives the slide fastener, and for this purpose it must be arranged in the rear or the short part 47 of the tie 18, rather than in the front part 19. In this way, the appearance of the front part 19 of the tie is substantially improved.

In order to introduce the slide fastener from the inside of the necktie knot 15 or the inside of the supporting and shaping member 3 into the bag-like opening of the short rear part 47 of the tie and to be able to assure dependable movement of the slide fastener, the material must not be pressed together at the bag-like opening but must be held open. This is done by arranging the spacer tube 29, which serves for the supporting, between the upper part 52 and the lower part 53 of the rear part 47 of the tie (FIG. 17). FIG. 17 has been shown slightly distorted for clarity in viewing. In order to make the clamp 24 and the tube 29, lying between the parts 52 and 53, visible, these parts have been spread apart and shown in perspective. In fact, they scarcely extend beyond the upper edge of the member 3.

In certain slide fasteners, for the unblocking of the slide fastener, it is important that the slide-fastener slide 5 be lifted by the pull tab 20 in the direction toward the neck loop 2 and that the slide 5 thus be freely displaceable. It is then possible easily to move the slide fastener tape 4 with respect to the slide 5 in the direction toward decreasing or increasing the size of the loop.

The upper stop for the movable slide can in this connection be secured by the guide tubes 9, 10 and, in another embodiment, by the spacer 29. It is also possible to use a stop having the shape of the small plate 40 held fast in the hole 41 by the clamp 24 and bent over at its free end to form a stop surface, with or without the member 3.

All individual parts and features mentioned in the specification and/or shown in the Figures as well as their permutations, combinations and variations form a part of the invention, namely for n individual parts and individual features having the values $n=1$ to $n=\infty$. All the individual parts mentioned are functional parts which therefore merely have to perform their function, regardless of their shape or material.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. In a pre-tied necktie comprising (a) a necktie front part, which is outward, and a necktie rear part, which is behind the front part and is inward; the tie having a meeting region at which the front and rear parts meet; connecting means for connecting the tie front and rear parts together at the meeting region;

(b) attaching means for attaching the tie to the wearer's neck; a slide-fastener connected to the attaching means, the slide-fastener comprising (1) a pair of tapes and (2) a slide for securing the tapes together at portions of the tapes below the slide, the tapes being apart above the slide; and (c) in the vicinity of the meeting region of the tie, respective guide and enveloping means receiving and holding the tapes for guiding them past the meeting region and also toward the wearer's neck; a spacer near the meeting region for spacing the guide and enveloping means and the tapes;

the improvement comprising means for retaining the slide in the vicinity of, but below, the meeting region;

the slide including an element through which the tapes slide for being secured together; and pull means extending away from the element means; said pull means being accessible for being held, to enable the tapes to move past the meeting region, without moving the slide with respect to the meeting region; and said pull means being operable for unlocking a locking means in the slide, said locking means preventing the tapes from sliding through the slide element when in locked condition.

2. The necktie of claim 1, wherein the necktie rear part has and defines in itself a protective cap which is at the side of the rear part facing away from the front part, the protective cap at least partially covering the slide.

3. The necktie of claim 2, wherein tie rear part is substantially shorter and narrower than the tie front part.

4. The necktie of claim 1, wherein the slide is disposed between the front part and the rear parts of the necktie.

5. The necktie of claim 4, wherein the tie rear part is substantially shorter and narrower than the tie front part.

6. The necktie of claim 1, wherein the tie rear part includes a slit for receiving therein at least part of the slide fastener.

7. The necktie of claim 1, wherein there area at least two of the guide and enveloping means, and the spacer is disposed between them.

8. The necktie of claim 1, wherein the slide fastener comprises hooks provided on each of the tapes and the hooks are connectable together by movement past the slide element.

9. The necktie of claim 8, the retaining means comprising a strap connected with the meeting region for holding the slide and the strap also being positionable at various orientations with respect to the slide.

10. The necktie of claim 1, wherein the necktie has a knot at the meeting region, the slide fastener and the guide means both being introduced within the knot, and the knot then being connected to the rear part of the tie, for enabling the slide fastener and guide means to be extendable into and the slide fastener extending into and along the rear part of the tie, and the rear part of the tie being shaped to receive and conceal the slide fastener tapes and the slide as the slide fastener moves through the rear part of the tie.

11. The necktie of claim 10, wherein the spacer is fixably located for positioning the tapes of the slide fastener and for maintaining the shape of the knot region of the tie.

12. The necktie of claim 1, wherein the rear part of the tie has a bag-like opening and the spacer is located within the bag-like opening for keeping the bag-like opening open for enabling passage of the slide fastener through the bag-like opening and the slide fastener being received inside the rear part, and the guide and enveloping means also in part being received within the bag-like opening.

13. The necktie of claim 1, wherein the spacer is fixably located for positioning the tapes of the slide fastener.

14. The necktie of claim 1, wherein the necktie is comprised of necktie material, the necktie material wraps around the guide and enveloping means and is attached thereto by an attachment thread.

* * * * *